US008887423B1

(12) United States Patent
Morgan

(10) Patent No.: US 8,887,423 B1
(45) Date of Patent: Nov. 18, 2014

(54) TRAFFIC SIGN AND SAFETY STAND

(71) Applicant: Joel T. Morgan, Santa Rosa, CA (US)

(72) Inventor: Joel T. Morgan, Santa Rosa, CA (US)

( * ) Notice: Subject to any disclaimer, the term of this patent is extended or adjusted under 35 U.S.C. 154(b) by 0 days.

(21) Appl. No.: 14/469,904

(22) Filed: Aug. 27, 2014

(51) Int. Cl.

| | |
|---|---|
| ***G09F 7/00*** | (2006.01) |
| ***G09F 13/00*** | (2006.01) |
| ***G09F 15/00*** | (2006.01) |
| *G09F 13/04* | (2006.01) |

(52) U.S. Cl.
CPC ..... *G09F 13/00* (2013.01); *G09F 15/0037* (2013.01); *G09F 15/0056* (2013.01); *G09F 2013/0472* (2013.01)
USPC ..... 40/612; 40/607.1; 116/63 P

(58) Field of Classification Search
USPC ..... 40/612, 607.1; 116/63 P
See application file for complete search history.

(56) References Cited

U.S. PATENT DOCUMENTS

| | | | | |
|---|---|---|---|---|
| 4,019,271 | A * | 4/1977 | Latimer | 40/603 |
| 4,772,869 | A * | 9/1988 | Grammas et al. | 116/63 C |
| 5,220,740 | A * | 6/1993 | Brault | 40/606.02 |
| 5,959,554 | A * | 9/1999 | Armstrong et al. | 340/908 |
| 5,974,712 | A * | 11/1999 | Kallionpaa | 40/612 |
| 6,299,124 | B1 | 10/2001 | Reback et al. | |
| 6,986,496 | B2 | 1/2006 | Woude | |
| 7,155,850 | B2 | 1/2007 | Wilinsky, Jr. et al. | |
| 8,424,549 | B1 | 4/2013 | Goldsmith et al. | |

* cited by examiner

*Primary Examiner* — Gary Hoge

(57) ABSTRACT

A portable traffic sign and safety stand suitable for use directing traffic under changing conditions. The traffic sign may be rotated in the safety stand to change traffic direction to drivers. The safety stand may include safety features such as lighted signs on the sides. In addition, the safety stand is of suitable height for use for stretching, and may have amenities such as cup holders, storage compartments, hand-held radio holders, and hand-held sign holders.

7 Claims, 4 Drawing Sheets

TRAFFIC SIGN AND SAFETY STAND

CROSS-REFERENCES TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

1. Field of the Invention

The present invention relates generally to support stands for vertical poles. More specifically, the present invention relates to a portable traffic sign with a support stand.

2. Description of the Related Art

Many devices have been designed to support poles in a vertical orientation. These have generally been developed to hold umbrellas, flags, tent poles, and the like. They are generally designed to support the weight of those items, and are usually fixed to the ground or a structure. None of these supports is suitable for use to support a traffic sign used by flagmen to direct traffic. Specifically, during construction of roadways, or at any time when there are changing traffic directions and a person is needed to direct traffic, flagmen will spend long stretches of time holding up traffic direction signs that indicate "slow" or "stop" instructions to drivers. This activity is tiring and can lead to fatigue and injury due to ergonomic effects. The present invention resolves this issue by providing a traffic sign on a portable support base. The support base holds the traffic sign in a vertical position and allows the flagman to easily change the sign orientation to alternate the instructions to drivers.

The support base of the present invention is also designed so that it may be used as a stretching device to relieve fatigue, and as a holding device for items that the flagman may require. The height of the support base allows the flagman to conduct leg stretches to relieve tired muscles. The top of the support base includes holding compartments for items such as radios, beverages, sunglasses, and hand-held signs. This invention is also suitable for use when portable signage is needed under special circumstances to direct traffic, cyclists or pedestrians, such as at special events, concerts, sporting events, or bicycle races.

BRIEF SUMMARY OF THE INVENTION

The present invention is a traffic sign with a a trapezoidal prism shaped support base. The traffic sign is a standard traffic sign on a pole with traffic instructions on either side, preferably "stop" on one side, and "slow" on the other. Near the bottom of the pole is a cross-hole with a pin through it that is used to maintain sign orientation. The support base has a vertical hole or tube in the center that the pole is inserted into. There are also slots on the top surface of the base at right angles that accommodate the pin in the bottom of the pole so when the traffic sign is inserted in the base, the pin prevents it from rotating.

The support base is of suitable height to be used for leg stretches by the flagman when not directing traffic. This allows the flagman to improve circulation and reduce fatigue associated with standing for long periods to direct traffic. In addition, the top surface of the base has round recesses appropriately sized to hold cups or bottles for beverages and square or rectangular compartments sized to hold a hand held radio transmitter or other items such as sunglasses. The top surface of the base also has slots sized to accept a hand-held flagging sign that may be needed for quick action or special circumstances.

The sides of the support base may include lighted signs for additional safety. The lighted signs are controlled either by a switch on the support base or by a remote control device. Power for the lighted signs is provided by one or more battery packs that are placed in compartments on the top surface of the base. The battery pack compartments have electrical connections that are wired internally in the base to the lighted signs. The electrical wiring is such that the flagman can adjust the switch or remote control to change the display on the lighted signs on the side of the base.

The bottom section of the base is hollow and serves as a ballast compartment. It is suitable for holding sand or water to provide weight for support in the event of windy conditions. There is a hole with a removable cap near the top of the ballast compartment for filling with ballast and a hole with a removable cap near the bottom of the ballast compartment for emptying the ballast.

The side surfaces of the support base have cut-outs with smoothly formed edges which serve as carrying handles for easy portability. The handles can be used to easily lift the support base into trucks or onto flatbeds when the ballast compartment is empty. There are two wheels affixed to an axle that is mounted on one side of the base opposite one of the carry handles. The axle assembly is rotatably affixed to the support base such that when the base is set flat on the ground, the wheels are at or just above the ground surface. To move the base to a new location when the ballast compartment is full, the flagman uses the opposite carrying handle to tilt the base so the wheels support the weight of the unit and the base can be rolled to a new location, similar to the method of moving a hand truck.

BRIEF DESCRIPTION OF THE SEVERAL VIEWS OF THE DRAWINGS

A more complete understanding of the present invention may be derived by referring to the detailed description and claims when considered in connection with the figures, wherein like reference numbers refer to similar items throughout the figures and:

DETAILED DESCRIPTION OF THE INVENTION

Figure 1:
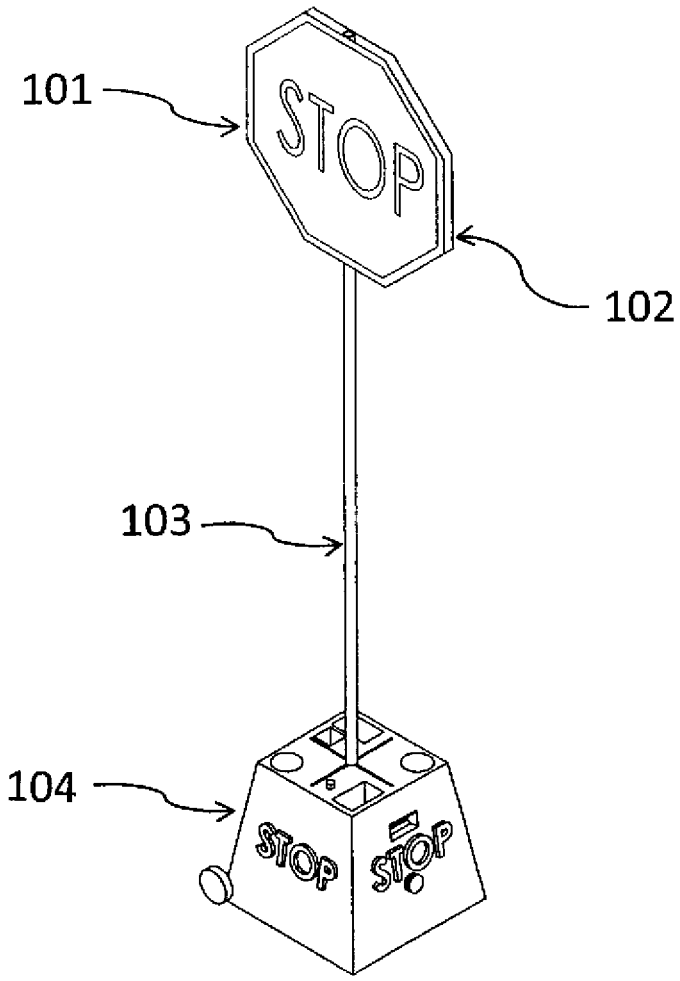
FIG. 1 is a perspective view of an embodiment of the present invention, shown with a stop sign installed and "stop" signage on the sides.
Figure 2:
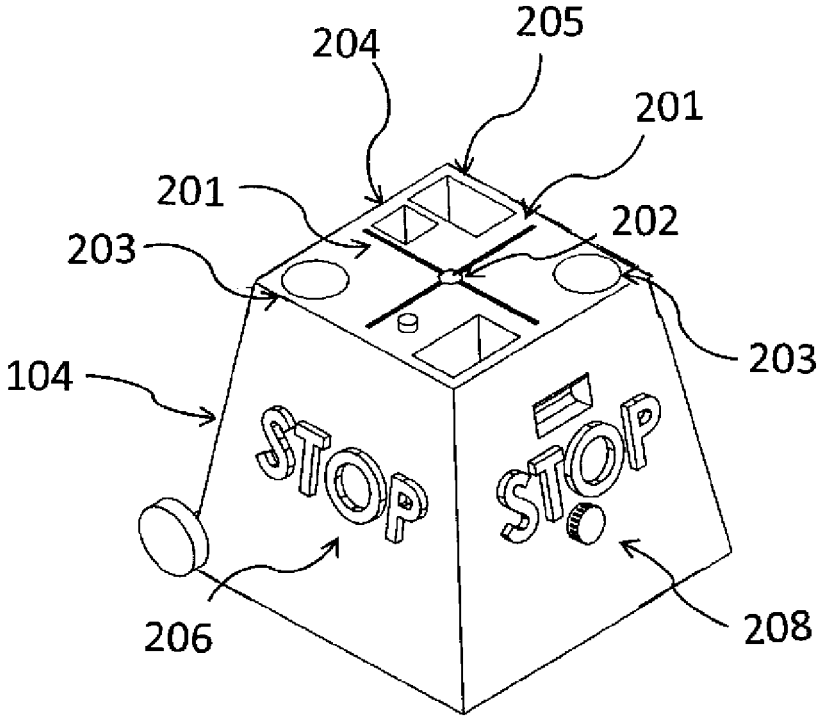
FIG. 2 is a perspective view of the support base.
Figure 3:
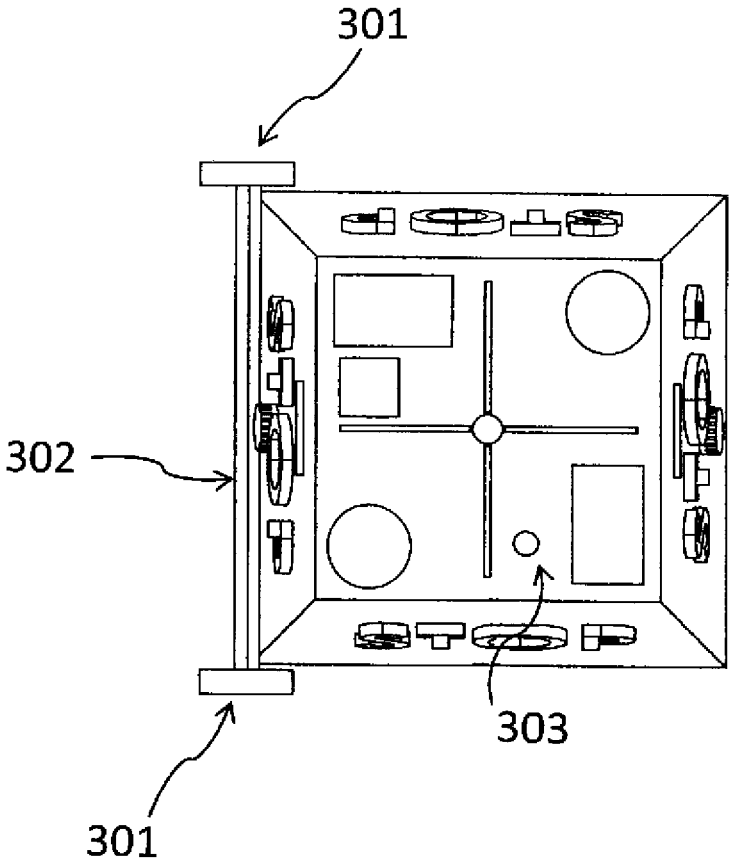
FIG. 3 is a top view of the support base.
Figure 4:
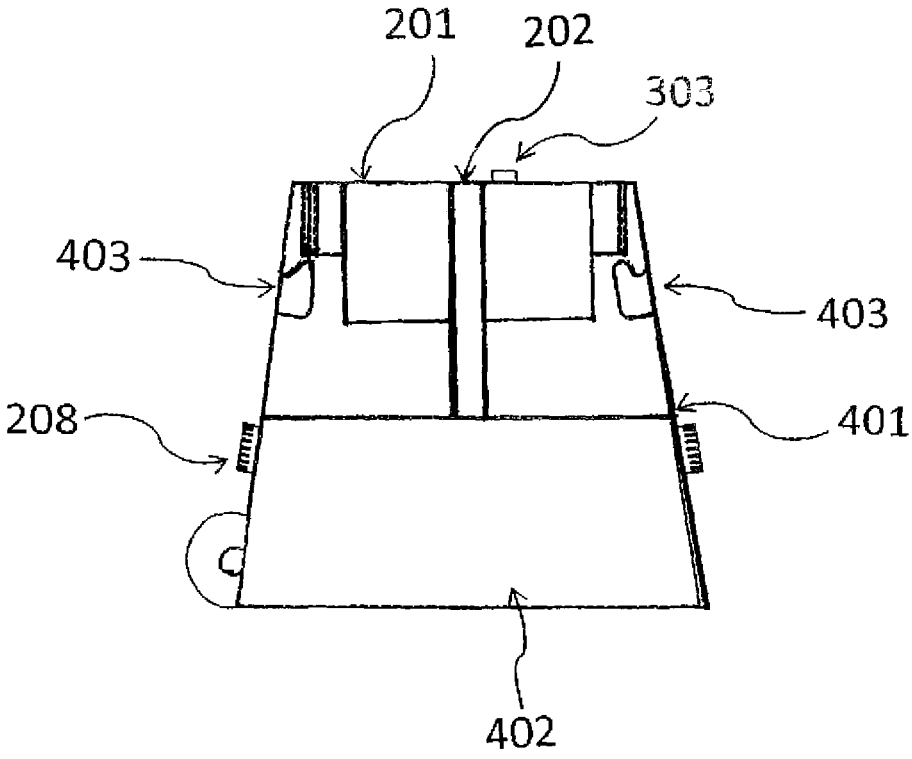
FIG. 4 is a cross-sectional view of the support base cut through the center.

In the following detailed description of the invention, reference is made to the accompanying drawings which form a part of the disclosure and, which show by way of illustration, and not of limitation, specific embodiments by which the invention may be practiced. The drawings, the foregoing discussion, and the following description are exemplary and explanatory only, and are not intended to limit the scope of the invention or its application in any manner.

The present invention is Traffic Sign and Safety Stand 101 that consists of a Support Base 104 and a Sign 102 permanently attached to the top of a Pole 103. The Support Base 104 is preferably made from molded plastic that is brightly colored to improve safety for the flagman, and is of appropriate height and stiffness to allow the flagman to use it for leg stretching when not directing traffic. The preferable height of the Support Base 104 is approximately 18 inches to facilitate use for leg stretches for most people. The Support Base 104 may have indented sections in the sides (not shown) suitable for use as footholds to facilitate stretching done by flagmen with shorter legs. The Sign 102 is a flat traffic sign with traffic instructions on either side, preferably "stop" on one side and "slow" on the other. In an alternate embodiment, the Sign 102 may be a cube or a triangular prism with the option to have different instructions on each face. The Pole 103 has a cross-pin (not shown) inserted horizontally through the Pole 103 near the bottom of the Pole 103 that is used to maintain orientation in the Support Base 104 after installation.

The Support Base 104 has a vertical Pole Support Tube 202 in the center that is appropriately sized for the Pole 103 and at least one Cross Slot 201 that is designed to accept the cross-pin (not shown). The Pole Support Tube 202 may be molded into and part of the Support Base 104, or it may be a separate component. In an alternate embodiment, the Support Base 104 is solid and simply has a hole that serves the function of the Pole Support Tube 202.

There is a Cross Slot 201 in the top of the Support Base 104 that extends through the Pole Support Tube 202 diameter. The Cross Slot 201 is wide and long enough to accommodate the cross-pin (not shown) such that the Pole 103 and Sign 102 can be lifted out and rotated 180 degrees to change the side of the Sign 102 that is facing traffic. In an preferred embodiment (as shown), there are two Cross Slots 201 to facilitate rotating the sign to a 90 degree position without having to re-orient the base for traffic coming from different directions. In an alternate embodiment, there may be more Cross Slots 201 to accommodate different sign configurations. For example, if the sign is a triangular prism, additional Cross Slots at 60 degree angles would be desirable to allow proper display of each face of the sign at the appropriate time. In a preferred embodiment, the Cross Slots 201 are wide enough to also serve the purpose of holding a hand-held sign paddle (not included). In that embodiment, the depth of the Cross Slots 201 is such that the hand-held sign paddle can be inserted into the slots such that the instructions on the hand-held sign are visible to drivers. In an alternate embodiment, the slots sized to hold the hand-held sign may be separate from the Cross Slots 201 used for Sign 102 orientation.

The Support Base 104 preferably has one or more Cup Holder Compartments 203 in the top surface that are appropriately sized to hold cups or bottled beverages. The Support Base 104 also preferably has one or more Rectangular Compartments 204 appropriately sized to hold a standard radio receiver as commonly used on construction sites, or other items such as sunglasses. In an alternate embodiment, the Rectangular Compartments 204 have covers (not shown) for protection of the stowed items. In yet another alternate embodiment, a Rectangular Compartment 204 includes a battery powered charging station (not shown) for a hand-held radio receiver or a cell phone.

The Support Base 104 preferably has Battery Compartments 205 with electrical connections (not shown) for a standard battery pack. The electrical connections for the battery packs are electrically connected to the Sign Switch 303. The Sign Switch 303 is electrically connected to the Lighted Signs 206 on the sides of the Support Base 104 such that the flagman can toggle the Sign Switch 303 to turn the Lighted Signs 206 off or on and to the desired setting. The Lighted Signs 206 are preferably suitable electronic signs that can be configured to light up continuously or in a flashing mode with "STOP," "SLOW," or other suitable traffic instructions. The Lighted Signs 206 may be any suitable configuration and may be formed by a display of LED lights. In an alternate embodiment, the Lighted Signs 206 are not adjustable (as shown) or are signs that are not lit. In such an embodiment, the wording preferably says "CAUTION" or other non-distinct instructive wording.

There are at least two Carrying Handles 403 preferably created by recesses on the sides of the Support Base 104 and that have smooth edges to allow the flagman to easily lift the base for general transportation. In an alternate embodiment, the Carrying Handles 403 may be external handles (not shown) rather than recesses and may be located on the top of the Support Base 104. An Axle Assembly 302 consisting of two Wheels 301 attached to an axle, is rotatably affixed to the Support Base 104 near the bottom and opposite one of the Carrying Handles 403. In a preferred embodiment, there are holes (not shown) molded into the Support Base 104 that accommodate the Axle Assembly 302 by inserting the axle through them and then attaching the Wheels 301 to either end of the axle. The position of the Axle Assembly 302 is such that when the Support Base 104 is flat on the ground, the Wheels 301 are at or just above the ground surface. To reposition the Traffic Sign and Safety Stand 101, the flagman tilts the Support Base 104 using the Carrying Handle 403 opposite the Wheels 301 so all of the weight is on the Wheels 301 and the Traffic Sign and Safety Stand 101 can be easily rolled to a new location.

In a preferred embodiment, there is a Ballast Compartment 402 at the bottom section of the Support Base 104. There is at least one hole with a Ballast Compartment Cap 208 near the top of the Ballast Compartment 402 for filling the Ballast Compartment 402 with sand or water. This adds weight to the Traffic Sign and Safety Stand 101 to keep it in place under windy conditions, or on slanted surfaces. There is preferably at least one hole (not shown) with a Ballast Compartment Cap 208 near the bottom of the Ballast Compartment 402 for emptying the sand or water from the Ballast Compartment 402. In a preferred embodiment, there is a Ballast Compartment Separator 401 at the top of the Ballast Compartment 402 that keeps the sand or water separated from the electrical wiring for the Lighted Signs 206, and also prevents the sand or water from leaking out through the Carrying Handles 403 when moving the Traffic Sign and Safety Stand 101. In an alternate embodiment, the Support Base 104 is solid and the weight is not adjustable. In yet another alternate embodiment, the Support Base 104 has external attachment means for sand bags or other weight adding devices.

Many modifications and variations of this invention may be made without departing from its spirit and scope, as will be appreciated by those skilled in the art. For example, the Lighted Signs 206, may be connected to a wireless receiver to allow remote control operation, or there may be a method to add footholds on top of the Support Base 104 to accommodate flagmen of taller height who will use the Support Base 104 for stretching. In addition, the top surface of the Support Base 104 may be hinged or removable so that the top portion of the Support Base 104 can be used as a storage compartment or pre-fitted with an insulated cooler or similar device. The specific embodiments described herein are offered by way of example only. The embodiments were chosen and described in order to best explain the principles of the invention and its practiced applications.

What is claimed is:

1. A traffic sign and safety stand comprising: a trapezoidal prism shaped base with at least two carrying handles and a vertical hole in the center; a traffic sign affixed to a pole that is removably inserted in said vertical hole; a means to prevent rotation of said pole after insertion into said vertical hole; a locating means that allows insertion of said pole at 180 degrees; and two wheels attached to an axle, said axle rotatably attached at the bottom edge of one side of said base opposite one of the said carrying handles.

2. The traffic sign and safety stand of claim 1 wherein the height of said support base is approximately 18 inches.

3. The traffic sign and safety stand of claim 1 wherein said base has one or more recesses in the top surface suitable for holding cups, bottled beverages, or hand-held radios.

4. The traffic sign and safety stand of claim 1 wherein said base has one or more lightable signs on one or more sides, a switch to operate said lightable signs, and a means for holding batteries and electrically connecting said batteries to said switch.

5. The traffic sign and safety stand of claim 1 wherein said base is hollow and has holes with caps in the sides and/or top to enable filling said hollow base with ballast.

6. The traffic sign and safety stand of claim 1 wherein said base has one or more slots to accommodate a hand-held sign paddle.

7. The traffic sign and safety stand of claim 1 with locating means that allows insertion of said pole at 90 degree increments.

* * * * *